US005855066A

United States Patent [19]

Manger

[11] Patent Number: 5,855,066

[45] Date of Patent: Jan. 5, 1999

[54] DISPOSABLE SHAVING UNIT

[76] Inventor: John J. Manger, 542 N. Magee St., Southampton, N.Y. 11968

[21] Appl. No.: 985,416

[22] Filed: Dec. 4, 1997

[51] Int. Cl.[6] ..... B26B 21/44; A45D 40/00

[52] U.S. Cl. ..... 30/41; 30/535

[58] Field of Search ..... 30/41, 526, 532, 30/535, 537, 538

[56] References Cited

U.S. PATENT DOCUMENTS 4,129,942 12/1978 Denizman ..... 30/41

4,760,642 8/1988 Kwak ..... 30/41 X 5,092,041 3/1992 Podolsky ..... 30/41

*Primary Examiner*—Douglas D. Watts

[57] ABSTRACT

A disposable shaver is provided including a handle portion including a lower compartment for containing and dispensing a first fluid and an upper compartment for containing and dispensing a second fluid. Further provided is a blade assembly coupled to a top of the handle and having a blade coupled thereto.

4 Claims, 3 Drawing Sheets

DISPOSABLE SHAVING UNIT

BACKGROUND OF THE INVENTION

1. Field of the Invention

The present invention relates to disposable razors and more particularly pertains to a new single unit Disposable shaving system for dispensing two different fluids from a single disposable razor unit.

2. Description of the Prior Art

The use of disposable razors is known in the prior art. More specifically, disposable razors heretofore devised and utilized are known to consist basically of familiar, expected and obvious structural configurations, notwithstanding the myriad of designs encompassed by the crowded prior art which have been developed for the fulfillment of countless objectives and requirements.

Known prior art disposable razors include U.S. Pat. No. 4,908,945; U.S. Pat. No. 5,269,062; U.S. Pat. Des. 344,365; U.S. Pat. No. 5,337,478; U.S. Pat. No. 5,134,775; and U.S. Pat. No. 5,070,611.

In these respects, the single unit disposable shaving system according to the present invention substantially departs from the conventional concepts and designs of the prior art, and in so doing provides an apparatus primarily developed for the purpose of dispensing two different fluids from a single disposable razor unit.

SUMMARY OF THE INVENTION

In view of the foregoing disadvantages inherent in the known types of disposable razors now present in the prior art, the present invention provides a new single unit disposable shaving system construction wherein the same can be utilized for dispensing two different fluids from a single disposable razor unit.

The general purpose of the present invention, which will be described subsequently in greater detail, is to provide a new single unit disposable shaving system apparatus and method which has many of the advantages of the disposable razors mentioned heretofore and many novel features that result in a new single unit disposable shaving system which is not anticipated, rendered obvious, suggested, or even implied by any of the prior art disposable razors, either alone or in any combination thereof.

To attain this, the present invention generally comprises a cylindrical handle portion including a bottom face, a tubular periphery. The tubular periphery is coupled to the bottom face and extends upwardly therefrom defining an interior space and an open top with a peripheral edge. The peripheral edge of the open top has an annular flange coupled thereto which extends radially outwardly therefrom. The handle portion further has a divider integrally coupled therein for defining an elongated lower compartment and a short upper compartment. The bottom face is defined by an inboard portion with a cylindrical configuration and a diameter less than that of the periphery of the handle. The bottom face further has an outboard portion with a semi-spherical configuration. As shown in FIG. 4, the outboard portion has a button valve slidably situated thereon for allowing the dispensing of the shaving lotion from within the lower compartment. Next provided is a lid having a circular bottom face and a tubular periphery coupled thereto and extended upwardly therefrom for defining an open top. In use, the lid is sized and shaped such that open top thereof is adapted for releasaby engaging the inboard portion of the bottom face of the housing. As best shown in FIG. 4, a blade assembly is provided including a lower extent with a frustoconical configuration defining a closed top and an open bottom. A periphery of the open bottom is equipped with an annular indentation formed in an inner surface thereof for removably coupling with the annular flange of the handle. As such, the short upper compartment of the handle may be releasably sealed. The lower extent further has a tubular inlet integrally coupled to a top thereof and extends upwardly and outwardly therefrom. For allowing fluid to be dispensed from the short upper compartment, the inlet is further in fluidic communication with the short upper compartment of the handle. The blade assembly further includes an intermediate extent integrally coupled to the top of the lower extent of the blade assembly and extending upwardly and outwardly therefrom. The intermediate extent resides in a plane in which the tubular inlet resides and extends in a direction forming a right angle with the tubular inlet. An upper extent takes the form of a blade coupled to a top of the intermediate extent. The blade has a rectangular configuration with at least one blade coupled to a front face thereof. The blade resides in a plane which resides in perpendicular relationship with an axis about which the intermediate extent resides. Also included is a cap having a circular top face and a tubular periphery coupled thereto and extended downwardly therefrom. As such, an open bottom is defined for releasaby engaging the tubular inlet of the blade assembly. A blade cover is provided with a rectangular front face and a periphery coupled thereto and extending rearwardly therefrom for releasably engaging the blade of the blade assembly for covering the same.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new single unit disposable shaving system apparatus and method which has many of the advantages of the disposable razors mentioned heretofore and many novel features that result in a new single unit disposable shaving system which is not anticipated, rendered obvious, suggested, or even implied by any of the prior art disposable razors, either alone or in any combination thereof.

It is another object of the present invention to provide a new single unit disposable shaving system which may be easily and efficiently manufactured and marketed.

It is a further object of the present invention to provide a new single unit disposable shaving system which is of a durable and reliable construction.

An even further object of the present invention is to provide a new single unit disposable shaving system which is susceptible of a low cost of manufacture with regard to both materials and labor, and which accordingly is then susceptible of low prices of sale to the consuming public, thereby making such single unit disposable shaving system economically available to the buying public.

Still yet another object of the present invention is to provide a new single unit disposable shaving system which provides in the apparatuses and methods of the prior art some of the advantages thereof, while simultaneously overcoming some of the disadvantages normally associated therewith.

Still another object of the present invention is to provide a new single unit disposable shaving system for dispensing two different fluids from a single disposable razor unit.

Even still another object of the present invention is to provide a new single unit disposable shaving system that includes a handle portion including a lower compartment for containing and dispensing a first fluid and an upper compartment for containing and dispensing a second fluid. Further provided is a blade assembly coupled to a top of the handle and having a blade coupled thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
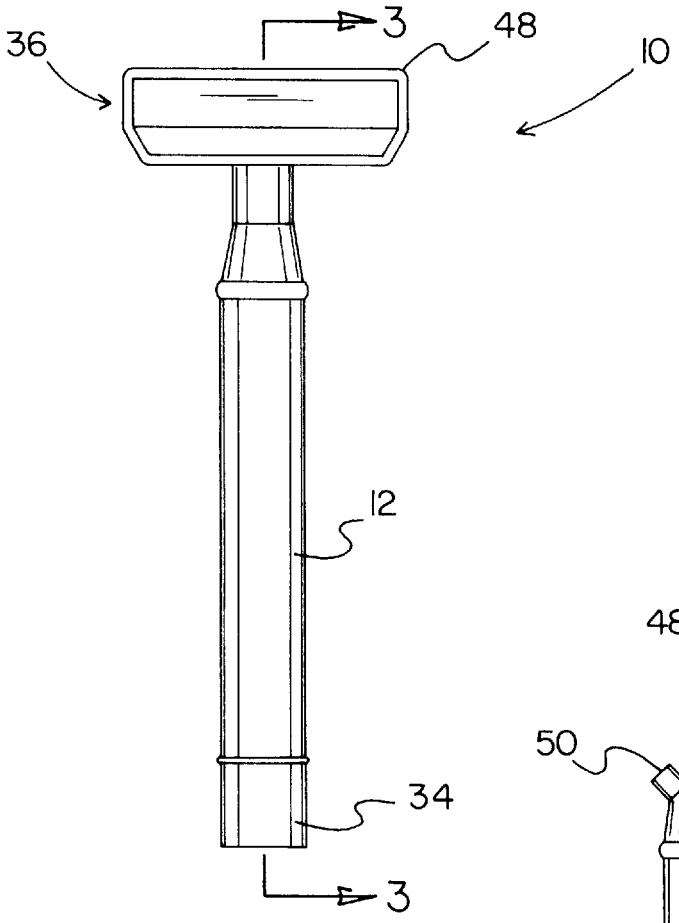
FIG. 1 is a front view of a new single unit disposable shaving system according to the present invention.
Figure 2:
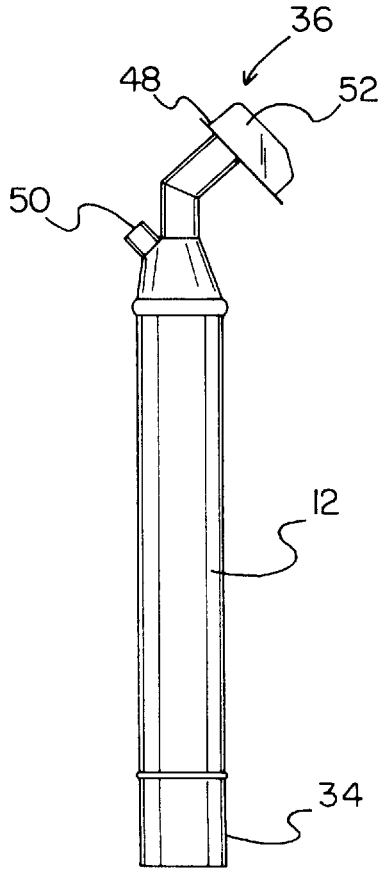
FIG. 2 is a side view of the present invention.

With reference now to the drawings, and in particular to FIGS. 1 through 4 thereof, a new single unit Disposable shaving system embodying the principles and concepts of the present invention and generally designated by the reference numeral 10 will be described.

The present invention, as designated as numeral 10, includes a cylindrical handle portion 12 including a bottom face, a tubular periphery. The tubular periphery is coupled to the bottom face and extends upwardly therefrom defining an interior space 14 and an open top 16 with a peripheral edge 18. The peripheral edge of the open top has an annular flange 20 coupled thereto which extends radially outwardly therefrom.

Figure 4:
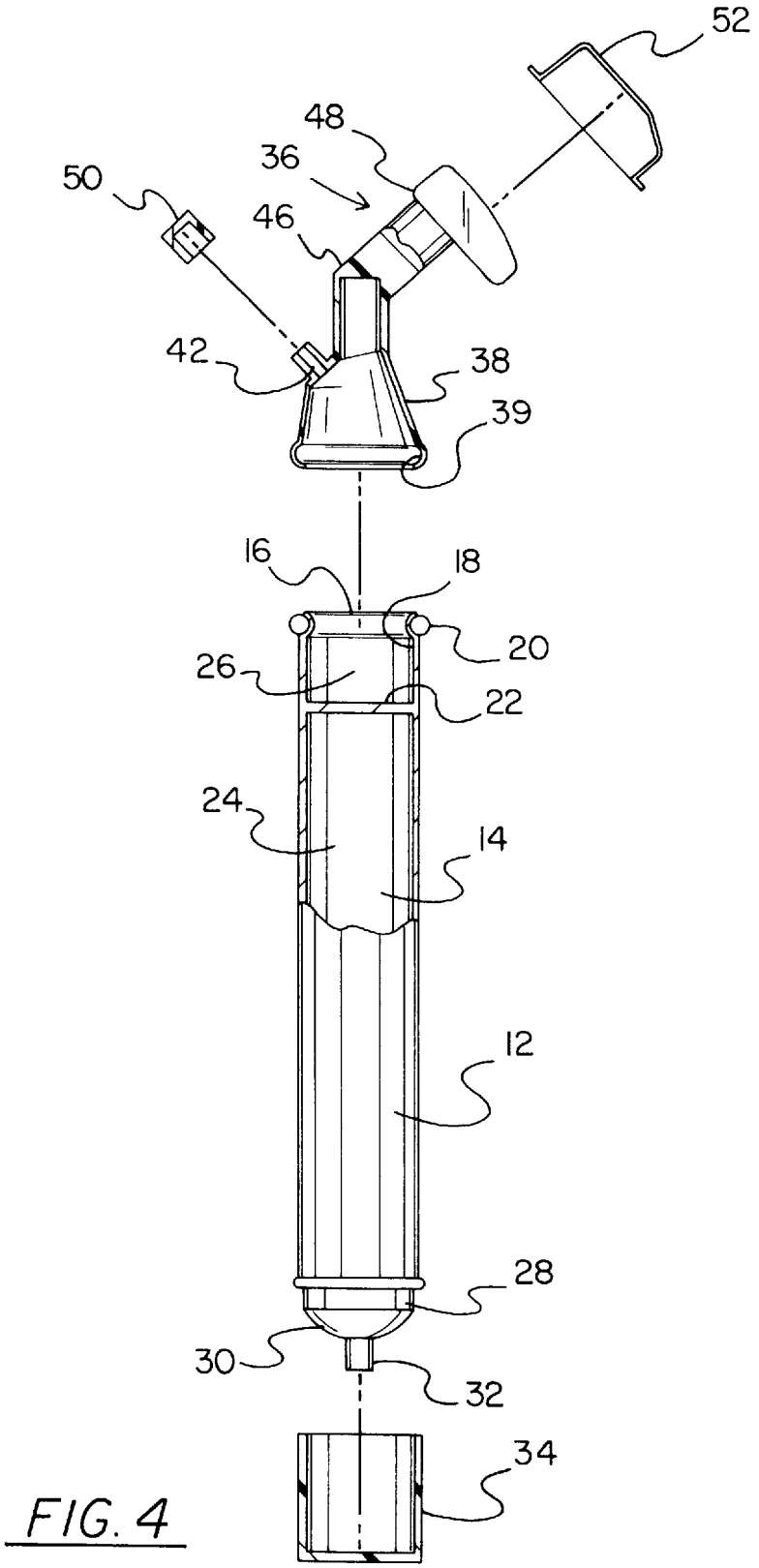
FIG. 4 is an exploded view of another one of the embodiments of the present invention.

The handle portion further has a circular divider 22 integrally coupled therein for defining an elongated lower compartment 24 and a short upper compartment 26. The bottom face is defined by an inboard portion 28 with a cylindrical configuration and a diameter less than that of the periphery of the handle. The bottom face further has an outboard portion 30 with a semi-spherical configuration. As shown in FIG. 4, the outboard portion has a button valve 32 slidably situated thereon for allowing the dispensing of the shaving lotion from within the lower compartment. It should be noted that the lower compartment is under pressure for dispensing shaving cream or gel and the upper compartment is maintained at atmospheric pressure for dispensing after shave lotion or bath oil.

Next provided is a lid 34 having a circular bottom face and a tubular periphery coupled thereto and extended upwardly therefrom for defining an open top. In use, the lid is sized and shaped such that the open top thereof is adapted for releasaby engaging the inboard portion of the bottom face of the housing.

Figure 3:
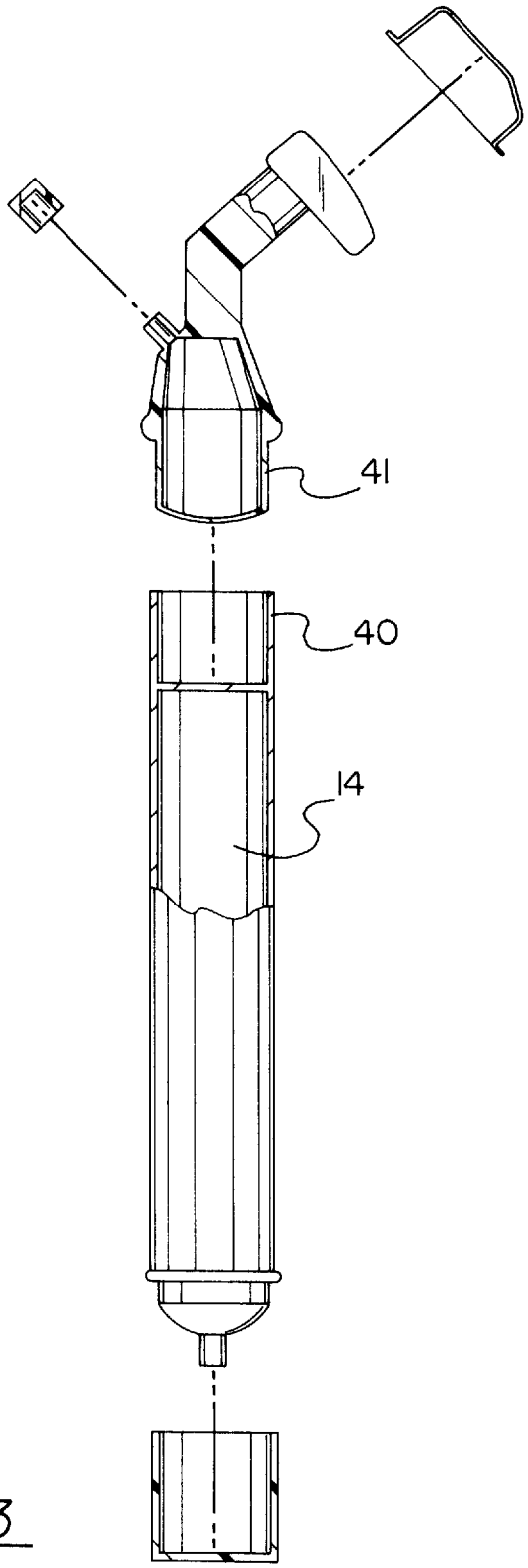
FIG. 3 is an exploded view of one of the embodiments of the present invention.

As best shown in FIG. 4, a blade assembly 36 is provided including a lower extent 38 with a frusto-conical configuration defining a closed top and an open bottom. A periphery of the open bottom is equipped with an annular indentation 39 formed in an inner surface thereof for removably coupling with the annular flange of the handle. As an option, the annular flange may take the form of an elastomeric O-ring. As such, the short upper compartment of the handle may be releasably sealed. In an alternative embodiment, as shown in FIG. 3, the top peripheral edge and the lower extent of the blade assembly are maintained in a relative orientation by way of a slidable coupling between a tubular lip 40 of the lower extent of the blade assembly and an outer surface 41 of the upper compartment defined by the handle.

The lower extent further has a tubular inlet 42 integrally coupled to a top thereof and extends upwardly and outwardly therefrom. For allowing fluid to be dispensed from the short upper compartment of the handle, the inlet is further in fluidic communication therewith.

The blade assembly further includes an intermediate extent 46 integrally coupled to the top of the lower extent of the blade assembly and extending upwardly and radially outwardly therefrom. The intermediate extent resides in a plane in which the tubular inlet resides and extends in a direction forming a right angle with the tubular inlet. Ideally, as shown in FIG. 4, at least a portion of the intermediate extent is hollow for increasing the volume of fluid that the short upper compartment may contain. An upper extent 48 of the blade assembly takes the form of a blade coupled to a top of the intermediate extent. The blade has a rectangular configuration with at least one blade coupled to a front face thereof. The blade resides in a plane which resides in perpendicular relationship with an axis about which the intermediate extent resides.

Also included is a cap 50 having a circular top face and a tubular periphery coupled thereto and extended downwardly therefrom. As such, an open bottom is defined for releasaby engaging the tubular inlet of the blade assembly. A blade cover 52 is provided with a rectangular front face and a periphery coupled thereto and extending rearwardly therefrom for releasably engaging the blade of the blade assembly for covering the same.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A disposable shaver comprising, in combination:

a cylindrical handle portion including a bottom face, a tubular periphery coupled thereto and extending upwardly therefrom defining an interior space and an open top with a peripheral edge, the peripheral edge of the open top having an annular flange coupled thereto and extending radially outwardly therefrom, the handle portion further having a divider integrally coupled therein for defining an elongated lower compartment and a short upper compartment, the bottom face defined by an inboard portion with a cylindrical configuration and a diameter less than that of the periphery of the handle and an outboard portion with a semi-spherical configuration, the outboard portion having a button valve slidably situated thereon for allowing the dispensing of the shaving lotion from within the lower compartment;

a lid having a circular bottom face and a tubular periphery coupled thereto and extended upwardly therefrom for defining an open top for releasaby engaging the inboard portion of the bottom face of the housing;

a blade assembly including a lower extent with a frusto-conical configuration defining a closed top and an open bottom with a periphery having an annular indentation formed in an inner surface thereof for removably coupling with the annular flange of the handle thereby sealing the short upper compartment of the handle, the lower extent further having a tubular inlet integrally coupled to a top of the lower extent and extending upwardly and outwardly therefrom and further being in fluidic communication with the short upper compartment of the handle, the blade assembly further including an intermediate extent integrally coupled to the top of the lower extent of the blade assembly and extending upwardly and outwardly therefrom in a plane in which the tubular inlet resides and in a direction forming a right angle with the tubular inlet of the lower extent and an upper extent taking the form of a blade coupled to a top of the intermediate extent, the blade having a rectangular configuration with at least one blade coupled to a front face thereof, the blade residing in a plane which resides in perpendicular relationship with an axis about which the intermediate extent resides;

a cap having a circular top face and a tubular periphery coupled thereto and extended downwardly therefrom for defining an open bottom for releasaby engaging the tubular inlet of the blade assembly; and a blade cover with a rectangular front face and a periphery coupled thereto and extending rearwardly therefrom for releasably engaging the blade of the blade assembly for covering the same.

2. A disposable shaver comprising:

a handle including a lower compartment for containing and dispensing a first fluid and an upper compartment for containing and dispensing a second fluid; and a blade assembly coupled to a top of the handle and having a blade coupled thereto;

wherein the handle is releasably and slidably connected with the blade assembly for exposing an interior space of the upper compartment and allowing the manual refilling thereof with the second fluid, wherein the handle and blade assembly are coupled by way of an annular indentation and an annular flange;

wherein the lower compartment is pressurized and the upper compartment is at atmospheric pressure;

wherein the blade assembly has an inlet formed thereon which extends upwardly and outwardly away from the blade, the inlet having a removable cap for allowing selective dispensing of the second fluid.

3. A disposable shaver as set forth in claim 2 and further including a lid for releasably scaling the lower compartment.

4. A disposable shaver as set forth in claim 2 and further including a cover for removably covering the blade.

* * * * *